US008162451B2

(12) United States Patent
Saga et al.

(10) Patent No.: US 8,162,451 B2
(45) Date of Patent: Apr. 24, 2012

(54) PRESSURE BUFFER, INK-JET HEAD, AND INK-JET RECORDING APPARATUS

(75) Inventors: Yukihiro Saga, Chiba (JP); Toshiaki Watanabe, Chiba (JP)

(73) Assignee: SII Printek Inc. (JP)

( * ) Notice: Subject to any disclaimer, the term of this patent is extended or adjusted under 35 U.S.C. 154(b) by 907 days.

(21) Appl. No.: 11/906,844

(22) Filed: Oct. 4, 2007

(65) Prior Publication Data

US 2008/0084464 A1 Apr. 10, 2008

(30) Foreign Application Priority Data

Oct. 5, 2006 (JP) ..... 2006-274149
Sep. 10, 2007 (JP) ..... 2007-233865

(51) Int. Cl.
*B41J 2/175* (2006.01)

(52) U.S. Cl. ..... 347/85; 347/87

(58) Field of Classification Search ..... 347/84, 347/85, 86, 87, 92
See application file for complete search history.

(56) References Cited

U.S. PATENT DOCUMENTS 4,794,409 A * 12/1988 Cowger et al. ..... 347/87
4,814,786 A * 3/1989 Hoisington et al. ..... 347/88
5,936,650 A * 8/1999 Ouchida et al. ..... 347/89
6,095,642 A * 8/2000 Koitabashi et al. ..... 347/86
6,984,029 B2 * 1/2006 Bellinger et al. ..... 347/86
7,344,231 B2 * 3/2008 Talon et al. ..... 347/85
7,422,317 B2 * 9/2008 Miyazawa ..... 347/86
7,585,063 B2 * 9/2009 Okuda ..... 347/86
2005/0117003 A1 6/2005 Kyogoku et al. ..... 347/86

FOREIGN PATENT DOCUMENTS

EP 1403059 3/2004
EP 1502749 2/2005
FR 2827216 1/2003

* cited by examiner

*Primary Examiner* — Anh T. N. Vo
(74) *Attorney, Agent, or Firm* — Adams & Wilks

(57) ABSTRACT

A pressure buffer is disposed in an ink supply path that connects an ink supply source to an ink-jet head to suppress pressure fluctuations due to vibrations created by movement of a carriage. The pressure buffer includes a chamber having an ink flow inlet through which ink flows from the ink supply source into the chamber and an ink flow outlet through which the ink flows from the chamber to the ink-jet head. A partition wall disposed within the chamber extends at least partly along a side wall of the chamber to define an ink flow path that communicates at its upper end with the chamber and at its lower end with the ink flow outlet. A through-opening is provided in the partition wall in the vicinity of the ink flow outlet and through which the ink flows between the ink flow path and the chamber to suppress pressure fluctuations in the ink flow path. Alternatively, an air pocket may be provided in the partition wall in the vicinity of the ink flow outlet to reduce presure fluctuations in the ink flow path.

18 Claims, 18 Drawing Sheets

PRINTING DENSITY IN A CASE OF THE PENETRATING OPENING PORTION IS NOT PROVIDED IN THE PRESSURE BUFFER

PRINTING DENSITY IN THE CASE OF THE PENETRATING OPENING PORTION IS PROVIDED IN THE PRESSURE BUFFER

PRESSURE BUFFER, INK-JET HEAD, AND INK-JET RECORDING APPARATUS

BACKGROUND OF THE INVENTION

1. Field of the Invention

The present invention relates to an ink-jet head and an ink-jet recording apparatus for discharging ink onto a recording medium to be recorded thereon.

2. Description of the Prior Art

An ink-jet recording apparatus for recording characters and images on a recording medium by using an ink-jet head having a plurality of nozzles for discharging ink has been conventionally known.

An outline of the ink-jet recording apparatus will be described below. FIG. 1 is a schematic diagram of the ink-jet recording apparatus which includes a pressure buffer. The ink-jet recording apparatus includes at least ink supply means 30 for supplying ink, an ink-jet head 20 for discharging ink, an ink supply path 50 which is a path for supplying ink from the ink supply means 30 to the ink-jet head 20, a pressure buffer 10 provided in the ink supply path 50 in the vicinity of the ink-jet head 20, and a carriage 40 which includes the ink-jet head 20 and the pressure buffer 10 that are mounted therein.

The ink-jet recording apparatus performs printing in such a manner that the carriage 40 which includes the ink-jet head 20 mounted therein reciprocates on a recording medium. The arrow of FIG. 1 indicates the reciprocation of the carriage 40 on the recording medium. In the case of performing printing, when the carriage 40 is accelerated or decelerated, a pressure fluctuation is generated inside the ink-jet head 20 due to an inertia of ink provided in the ink supply path 50 which is filled with the ink. The pressure fluctuation causes deterioration in image quality in the case of recording characters or images on a recording medium, and further causes a discharge failure. For this reason, it is necessary to provide the pressure buffer 10 in the ink supply path 50, which connects the ink supply means 30 and the ink-jet head 20 to each other, in the vicinity of the ink-jet head 20 so that the pressure fluctuation can be suppressed as much as possible.

Here, an example of the conventional pressure buffer 10 will be described. FIG. 2 shows a state where the pressure buffer 10 and the ink-jet head 20 according to the prior art are connected to each other, that is, a structure of the carriage 40 of FIG. 1. Note that the arrow X of FIG. 2 indicates a gravity direction. In other words, a lower side of FIG. 2 indicated by the arrow X indicates a ground side. FIG. 3 is a cross-sectional diagram of the pressure buffer 10 of FIG. 2 taken along the line f-f'.

In FIG. 3, a main body 112 of the pressure buffer 10 has a concave portion 114 on at least one surface thereof, and a flexible film 111 is applied to the concave portion 114 so as to hermetically seal the concave portion, to thereby form a chamber 103. As shown in FIG. 2, the chamber 103 has at least an ink flow inlet 102 through which the ink flows into the chamber 103 from the ink supply means 30, and an opening portion 101 for supplying the ink to the ink-jet head 20. The chamber 103 is filled with the ink so as to prevent air bubbles which cause the discharge failure of the ink, from being contained in the chamber 103, so as to fill the ink through pressurization, and so as to obtain a stable characteristic to buffer pressure. The pressure buffer 10 described above is disclosed in JP 2005-14315 A.

Next, problems to be solved by the present invention will be described below.

In the structure according to the prior art, as shown in FIG. 2, the opening portion 101 of the pressure buffer 10 is provided at an uppermost portion of the pressure buffer 10. Accordingly, in order to connect the ink-jet head 20 to the pressure buffer 10 to each other, it is necessary to separately provide an ink supply path 105 such as a tube, between the opening portion 101 and the ink-jet head 20, outside the pressure buffer 10. As a result, there arise problems in that the number of components is increased, and manufacturing costs are increased. In addition, in a case of arranging the ink-jet head 20 and the pressure buffer 10 to be closer to each other, for example, it is necessary to separately provide a tube or the like. As a result, there arises a problem in that a peripheral space cannot be effectively used.

Further, there arises another problem in that, when vibration in the vertical direction is applied to the carriage 40, a space formed between positions indicated by a-a', that is, space between an uppermost position of the ink supply path 105 and a lowermost position of a nozzle 106 of the ink-jet head 20 becomes a space which is confined a pressure. As a result, the pressure fluctuation is generated due to the inertia of the ink provided in the space between the positions indicated by a-a' which is filled with the ink 113. Therefore, there arise problems in that the pressure fluctuation causes a meniscus 104 to be displaced in a positive or negative direction, and a volume of ink droplets to be discharged, or a discharge rate is modulated, which leads to density unevenness.

SUMMARY OF THE INVENTION

To solve the above-mentioned problems, according to a first aspect of the present invention, there is provided a pressure buffer, which is provided in a vicinity of an ink-jet head in an ink supply path that connects the ink-jet head to ink supply means that supplies ink to the ink-jet head to each other, the pressure buffer including:

a chamber having a concave portion provided in the pressure buffer, to which a flexible film is applied so as to hermetically seal the concave portion;

an ink flow outlet which communicates with an opening portion provided in the chamber, is connected to an ink flow path that is formed of a partition wall provided along a side wall of the chamber so as to partition the ink flow path from the chamber, is placed at a position lower than the opening portion, and an ink flow outlet through which ink flows from the chamber to the ink-jet head; and an ink flow inlet through which the ink flows into the chamber from the ink supply means.

According to a second aspect of the present invention, in the pressure buffer according to the first aspect, the chamber is filled with the ink so that air bubbles, which cause an ink discharge failure, are prevented from being contained in the chamber, the ink is filled in the chamber through pressurization, and so that a stable characteristic to buffer pressure is obtained.

According to a third aspect of the present invention, the pressure buffer of the first or second aspect of the present invention further includes a penetrating opening portion which is provided in the partition wall in the vicinity of the ink flow outlet, and through which the ink flows between the chamber and the ink flow path when pressure fluctuation is generated in the ink flow path.

According to a fourth aspect of the present invention, in the pressure buffer of the third aspect of the present invention, the opening portion has a flow resistance which is smaller than that of the penetrating opening portion.

According to a fifth aspect of the present invention, the pressure buffer of the first or second aspect of the present invention further includes an air pocket which is provided in the partition wall in the vicinity of the ink flow outlet for partitioning the chamber and the ink flow path from each other, and which alleviates the pressure fluctuation generated in the ink flow path by using resilience of the air.

According to a sixth aspect of the present invention, the pressure buffer of the first or second aspect of the present invention, further includes pressure suppressing means which is provided in the ink flow path in the vicinity of the ink flow outlet, and which suppresses a pressure fluctuation when the pressure fluctuation is generated in the ink provided in the ink flow path.

According to a seventh aspect of the present invention, an ink-jet head is configured to include the pressure buffer of any one of the first to the sixth aspects of the present invention.

According to an eighth aspect of the present invention, an ink-jet recording apparatus includes the ink-jet head of the seventh aspect of the present invention.

According to the present invention, in the pressure buffer in which the opening portion of the chamber is provided on the upper portion of the pressure buffer, the ink flow path is provided inside the pressure buffer. With this structure, the ink flow outlet can be provided in the lower portion of the pressure buffer without impairing the function of filling the pressure buffer with ink. Therefore, it is possible to directly connect the pressure buffer to the ink-jet head to each other without using the ink supply path such as the tube shown in FIG. 2. As a result, the manufacturing costs can be reduced, and a peripheral space can be effectively used when the ink-jet head and the pressure buffer are to be arranged to be closer to each other.

Further, in the partition wall in the vicinity of the ink flow outlet, there is provided pressure suppressing means which suppresses the fluctuation in pressure of ink, such as a penetrating opening portion or an air pocket. As a result, even when unnecessary vibration is applied to the ink-jet head, the pressure fluctuation generated in the ink flow path between the opening portion of the chamber and the ink-jet head can be effectively reduced or alleviated, and generation of the density unevenness is suppressed, thereby making it possible to drastically improve the image quality.

DETAILED DESCRIPTION OF THE PREFERRED EMBODIMENTS

Hereinafter, embodiments of the present invention will be described.

(First Embodiment)

A structure of a pressure buffer according to a first embodiment of the present invention will be described in detail.

Figure 4:
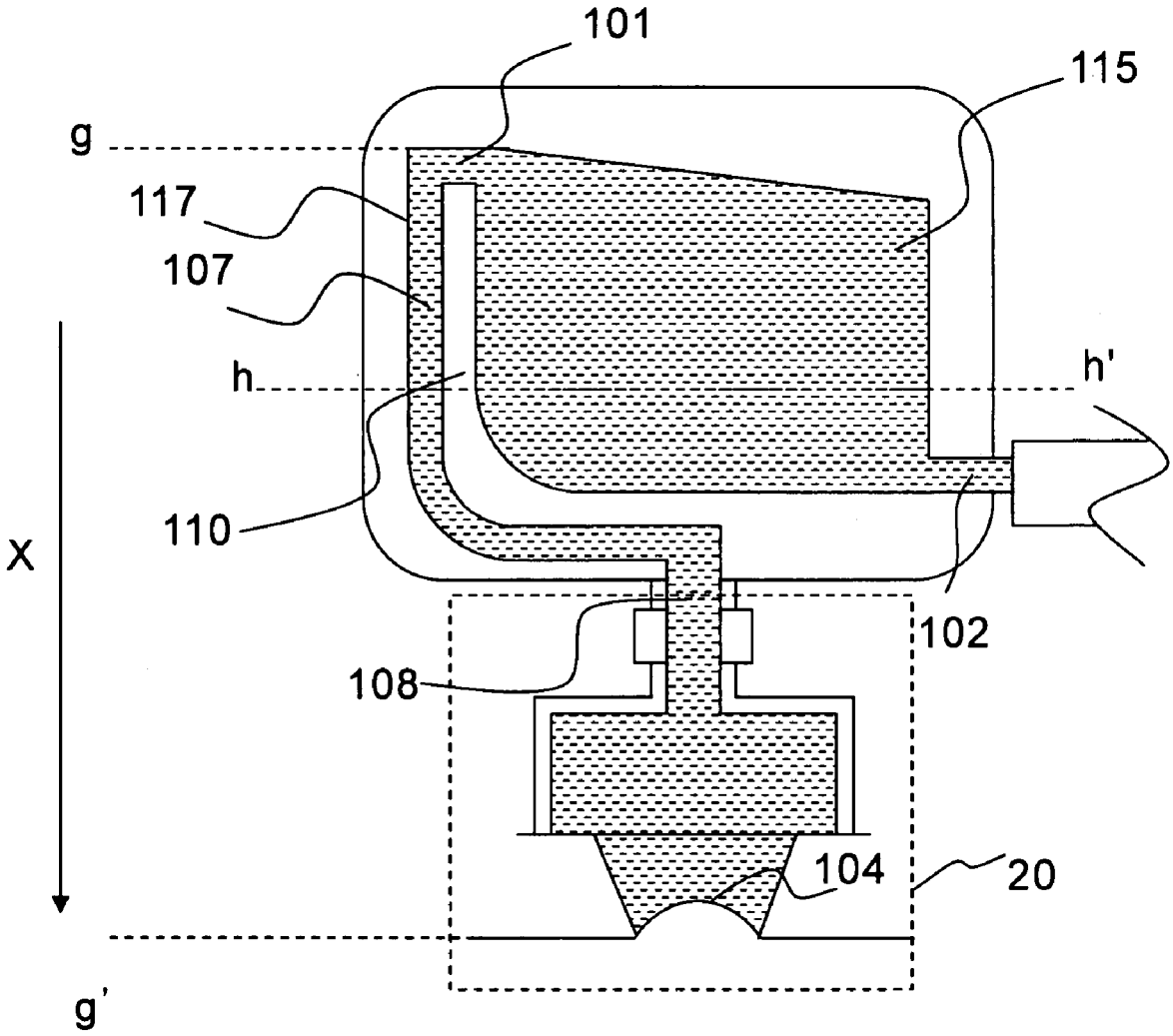
FIG. 4 is a diagram showing a structure of a pressure buffer according to a first embodiment of the present invention.
Figure 5:
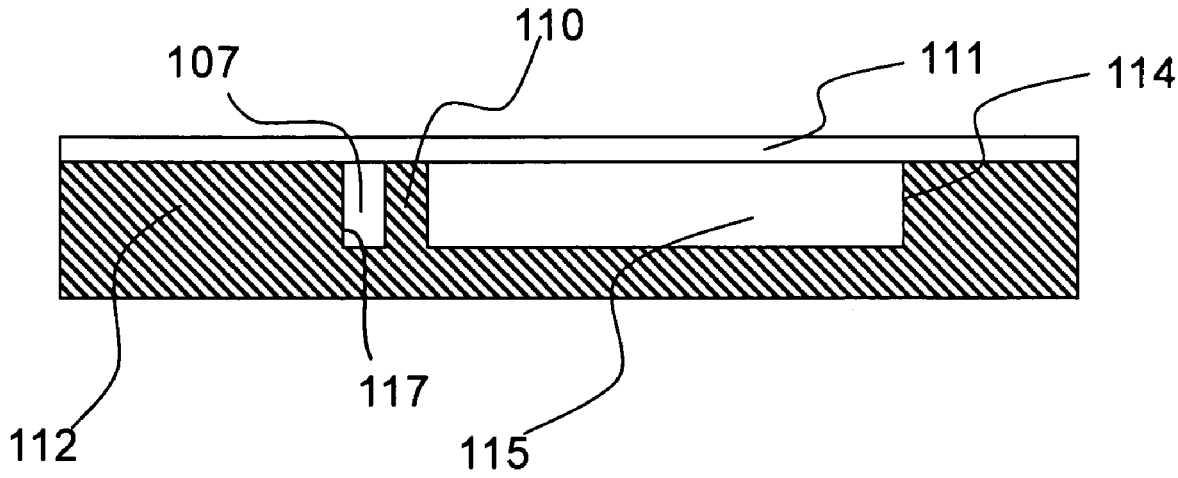
FIG. 5 is a cross-sectional diagram of the pressure buffer shown in FIG. 4 according to the first embodiment of the present invention.

FIG. 4 is a diagram showing the structure of the pressure buffer according to the first embodiment of the present invention. FIG. 5 is a cross-sectional diagram of the pressure buffer of FIG. 4 taken along the line h-h'. An arrow X of FIG. 4 indicates a gravity direction. In other words, a lower side of FIG. 4 indicates a ground side.

As shown in FIG. 5, the pressure buffer has a concave portion 114 formed in at least one surface of a main body 112, and has a partition wall 110 in the vicinity of a side wall 117 of the concave portion 114. A flexible film 111 is applied to the concave portion 114 and to the partition wall 110 so as to hermetically seal the concave portion 114, thereby forming a chamber 115 and an ink flow path 107.

The pressure buffer of FIG. 4 has a lower portion in the gravity direction, and has an upper portion in a direction opposite to the gravity direction. The partition wall 110 of FIG. 4 is formed upward from an ink flow outlet 108, which is provided in the lower portion of the pressure buffer and which extends at least partly along the inside of the side wall 117. The ink flow path 107 communicates with the chamber 115 through an opening or opening portion 101 at the upper end of the the partition wall 110 at the uppermost portion of the chamber 115. The chamber 115 has the opening portion 101 through which the ink flows from the chamber 115 to the ink flow path 107, and an ink flow inlet 102 through which the ink flows into the chamber 115 from the ink supply means 30.

Figure 6:
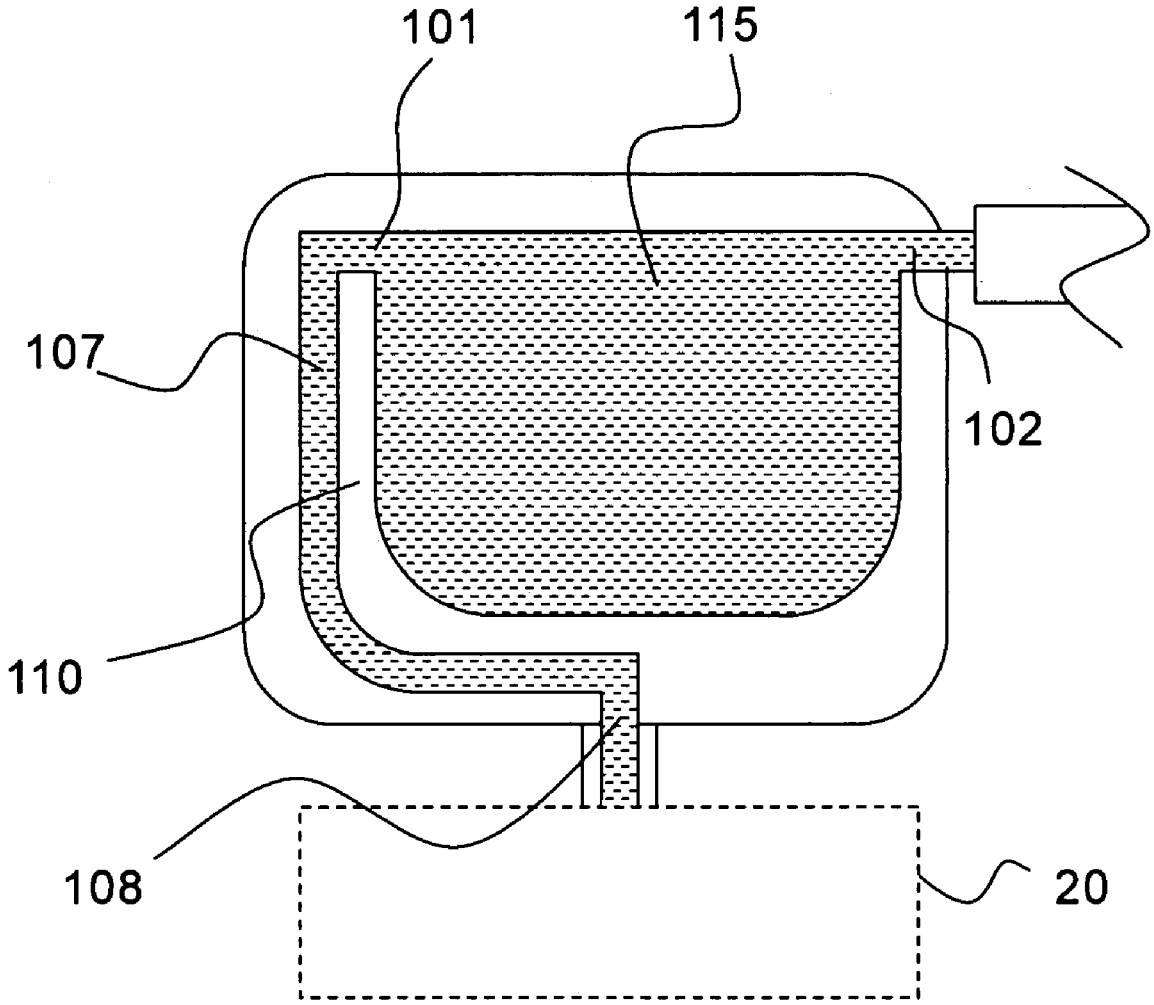
FIG. 6 is a diagram showing an example of the structure according to the first embodiment, in which an ink flow inlet and an opening portion are provided at the same height.
Figure 7:
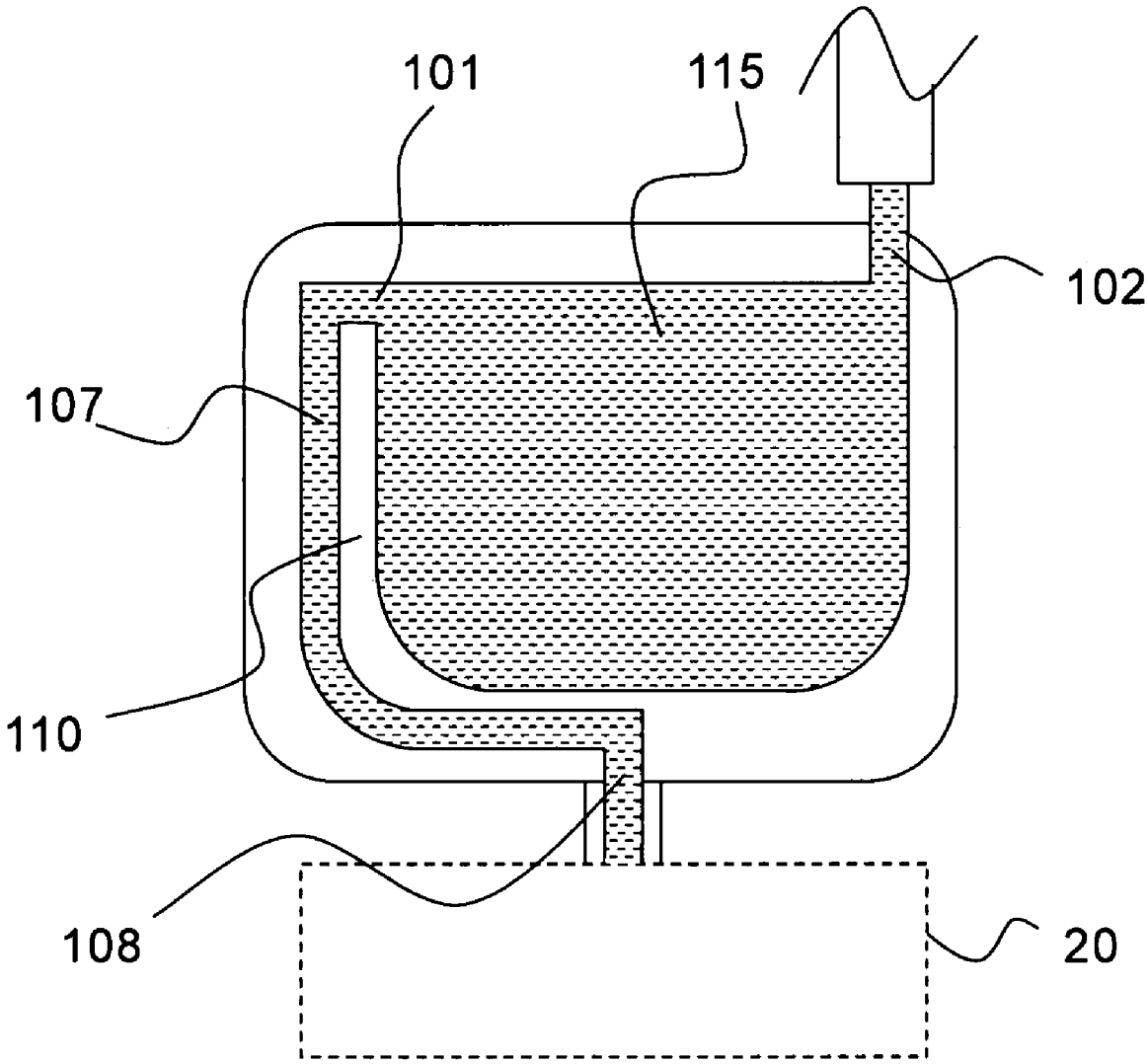
FIG. 7 is a diagram showing an example of the structure according to the first embodiment, in which the ink flow inlet is provided at a position higher than that of the opening portion.

As regards a positional relationship between the opening portion 101 and the ink flow inlet 102, as shown in FIG. 6, for example, the opening portion 101 and the ink flow inlet 102 may be arranged in parallel with each other and may be positioned at the same height. Further, as shown in FIG. 7, the opening portion 101 and the ink flow inlet 102 may be perpendicularly arranged, and the ink flow inlet 102 may be positioned higher than the opening portion 101. In the first embodiment, any structure may be employed as long as a function of filling the chamber 115 with ink is not impaired.

Figure 1:
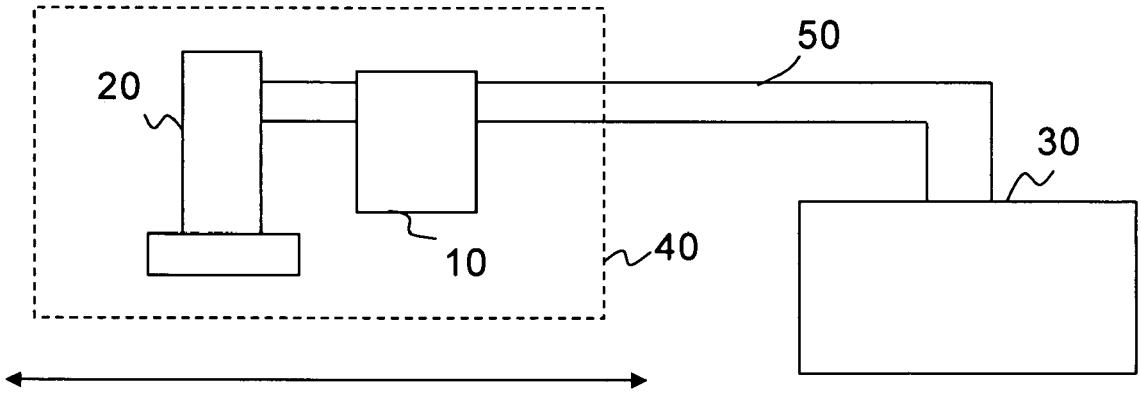
FIG.1 PRIOR ART
FIG. 1 is a schematic diagram of an ink-jet recording apparatus according to a prior art.
Figure 2:
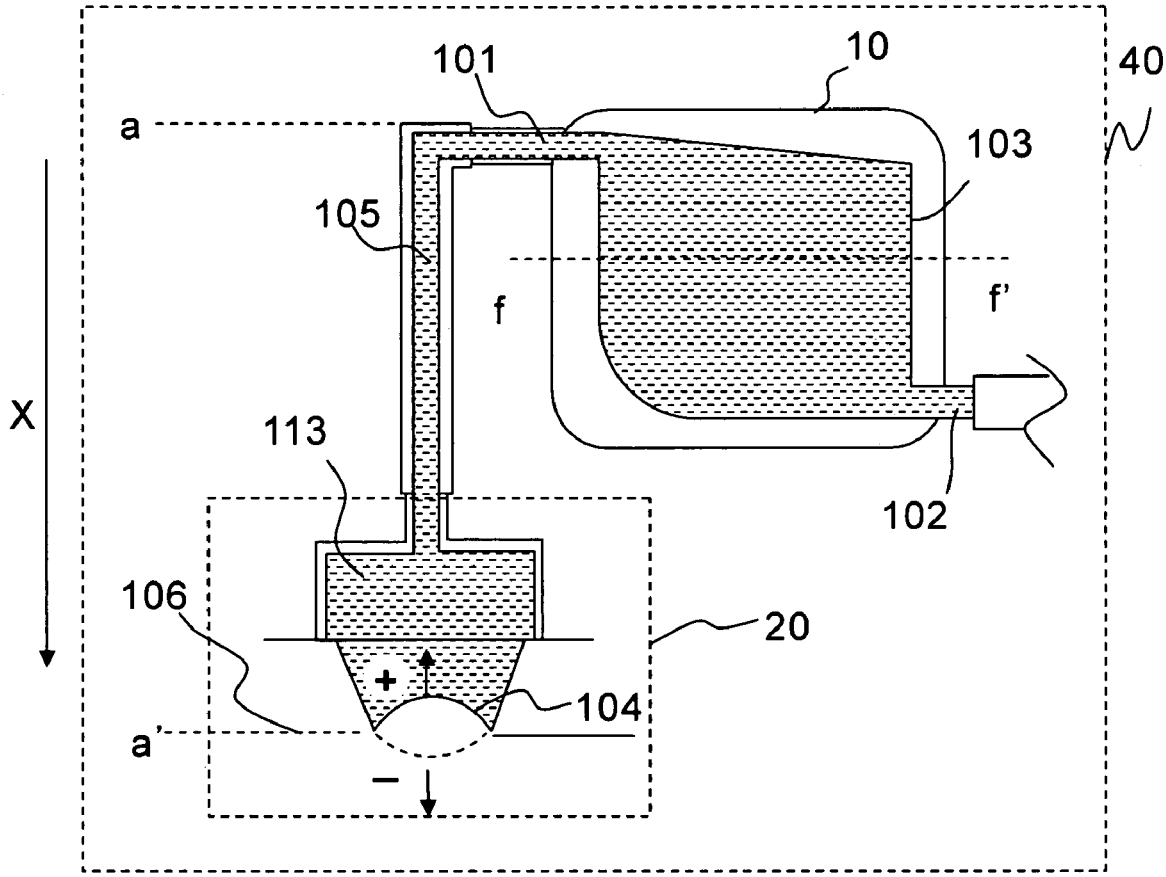
FIG.2 PRIOR ART
FIG. 2 is a diagram showing a structure of a carriage shown in FIG. 1 as a specific example of the prior art.
Figure 3:
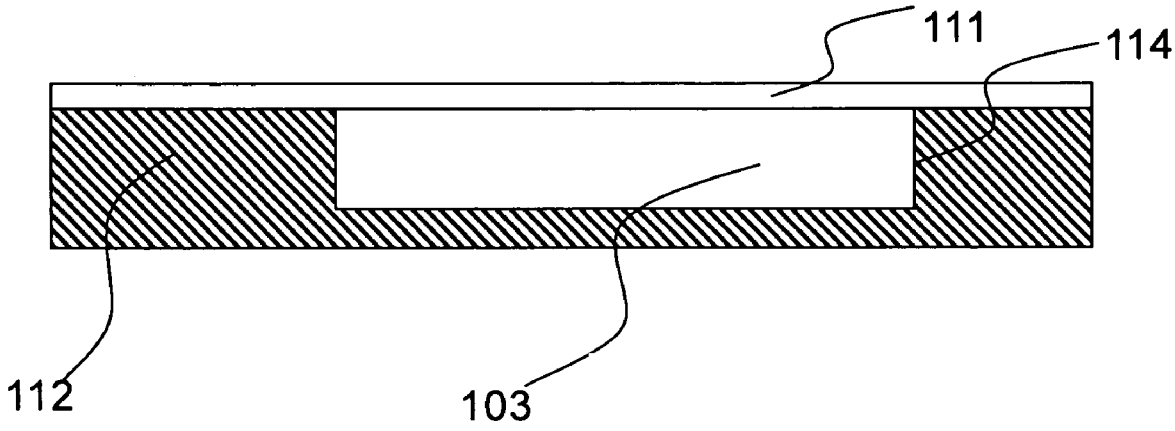
FIG.3 PRIOR ART
FIG. 3 is a cross-sectional diagram of a pressure buffer shown in FIG. 2 which is a specific example of the prior art.

Further, the ink flow path 107 communicates with the opening portion 101 of the chamber 115, and the ink flow outlet 108 and an ink-jet head 20 are connected to each other at a lowermost portion of the ink flow path 107. In this manner, the ink flow path 107 is provided in the pressure buffer, thereby making it possible to provide the ink flow outlet 108 in the lower portion of the pressure buffer. As a result, even when a tube or the like as shown in FIG. 2 is not provided, the pressure buffer can be directly connected to the ink-jet head, thereby enabling reduction in manufacturing costs. In addition, in a case where the ink-jet head and the pressure buffer are to be arranged to be closer to each other, a peripheral space can be effectively used.

The first embodiment as described above will be described in more detail below.

Figure 8:
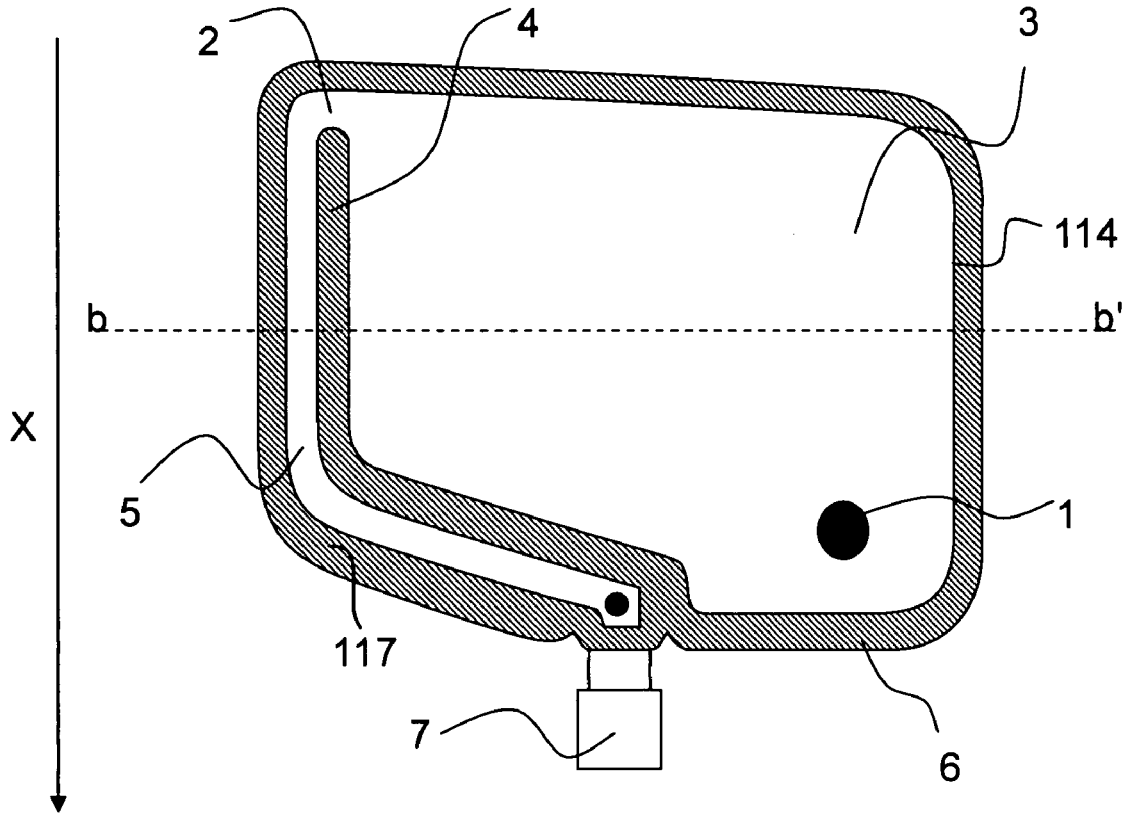
FIG. 8 is a diagram showing a specific example of the pressure buffer according to the first embodiment.
Figure 9:
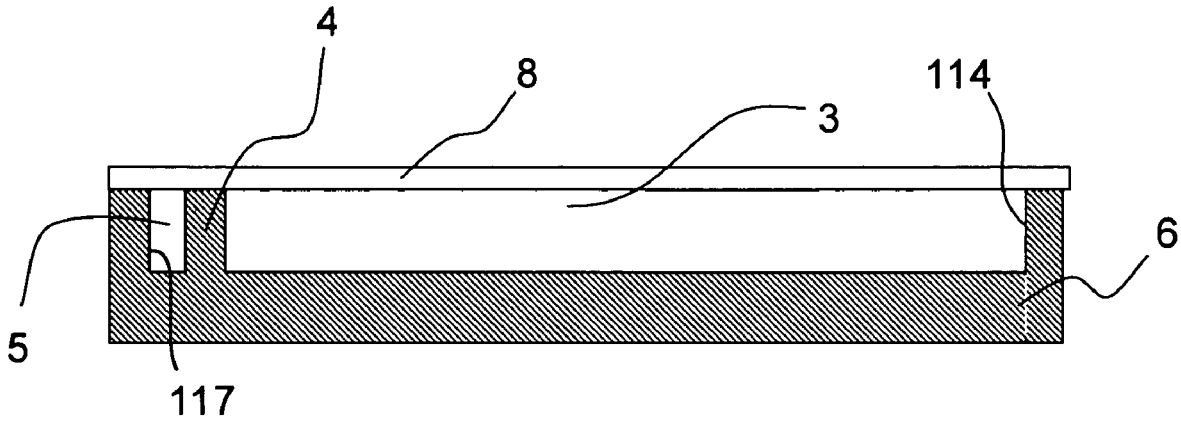
FIG. 9 is a cross-sectional diagram of the pressure buffer shown in FIG. 8 according to the first embodiment.

FIG. 8 shows an example of a case where the first embodiment is materialized as a plastic molding. In FIG. 8, the arrow X indicates the gravity direction. In other words, the lower part of FIG. 8 indicates the ground side. FIG. 9 is a cross-sectional diagram of the pressure buffer of FIG. 8 taken along the line b-b'.

In FIG. 9, a main body 6 is formed of plastic, has a concave portion 114 in one surface thereof, and has a partition wall 4 which corresponds to the partition wall 110 of FIG. 5 and which is provided in the concave portion 114. A flexible film 8 is applied to the concave portion 114 and to the partition wall 4 by thermo-compression bonding or the like so as to hermetically seal the concave portion 114, there by forming a chamber 3 and an ink flow path 5 which correspond to the chamber 115 and the ink flow path 107 of FIG. 5, respectively. In FIG. 8, an ink flow inlet 1 communicates with an ink supply path (not shown), and the ink flows into the chamber 3 from ink supply means (not shown) through the ink flow inlet 1. The partition wall 4 is formed from an ink flow outlet 7, which is provided in the lower portion of the pressure buffer, to an upper portion of the concave portion 114 along the inside of the side wall 117. The ink flow path 5 communicates with the chamber 3 through the opening portion 2 which is provided in the side wall 117. Further, the ink flow path 5 communicates with the ink flow outlet 7 on an opposite side of the opening portion 2, and the ink flows into the ink flow outlet 7 through the ink flow path 5. In addition, by forming the partition wall 4 along the side wall, the ink flow path 5 can be formed without impairing the original shape of the chamber and without largely reducing the volume of the chamber. As a result, it is possible to prevent the characteristics inherent in the pressure buffer from being impaired.

Note that it is desirable to form the partition wall 4 integrally with the main body 6, but the partition wall 4 may be formed by using another member to be bonded to the concave portion 114 by using an adhesive, thermo-compression bonding, or the like. In other words, any structure may be employed as long as the ink flow outlet 7 can be disposed at the lower portion of the pressure buffer without impairing the function of filling the pressure buffer with ink.

(Second Embodiment)

Next, a pressure buffer according to a second embodiment of the present invention will be described in detail.

Figure 10:
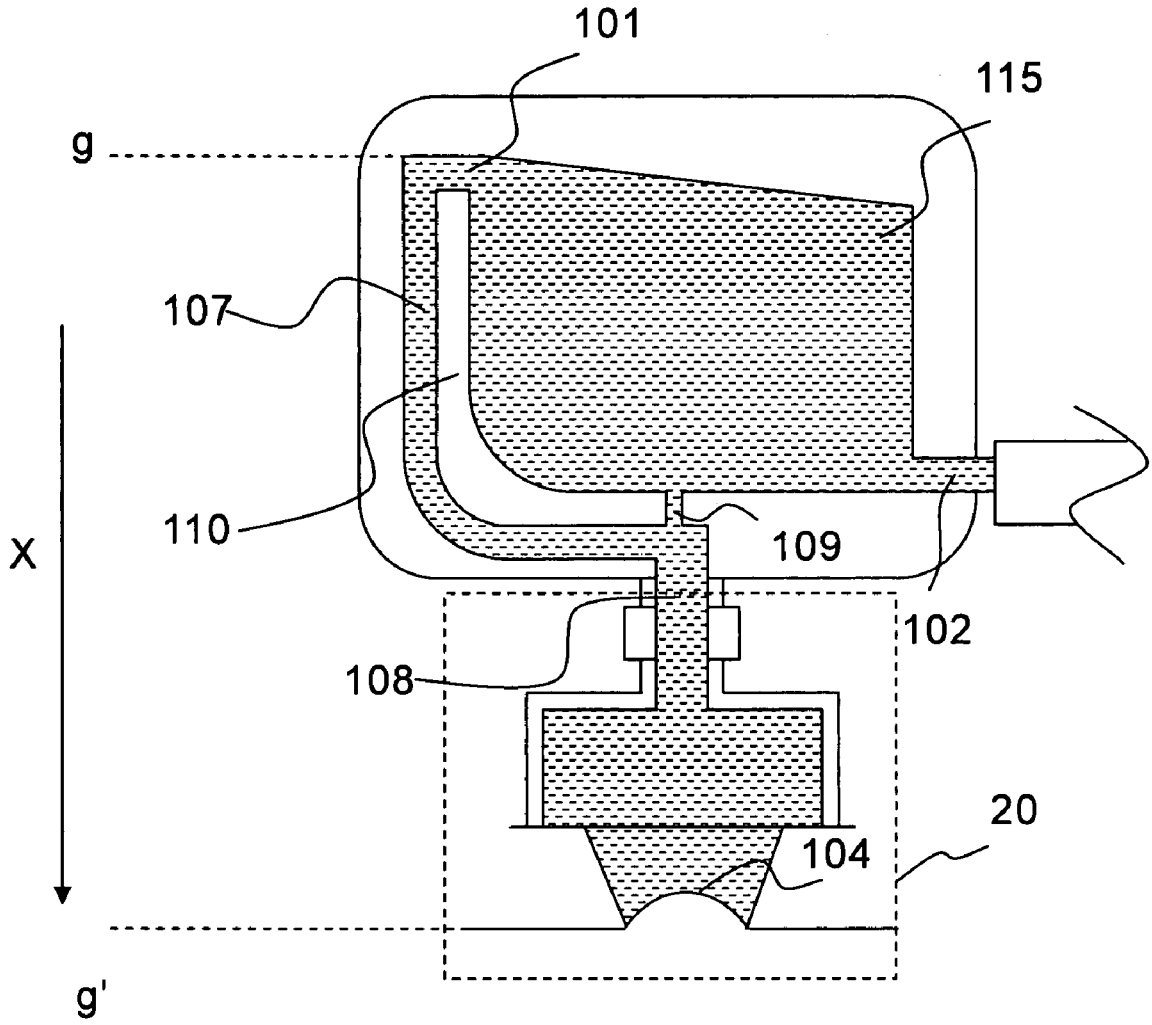
FIG. 10 is diagram showing a structure of a pressure buffer according to a second embodiment of the present invention.
Figure 11A:
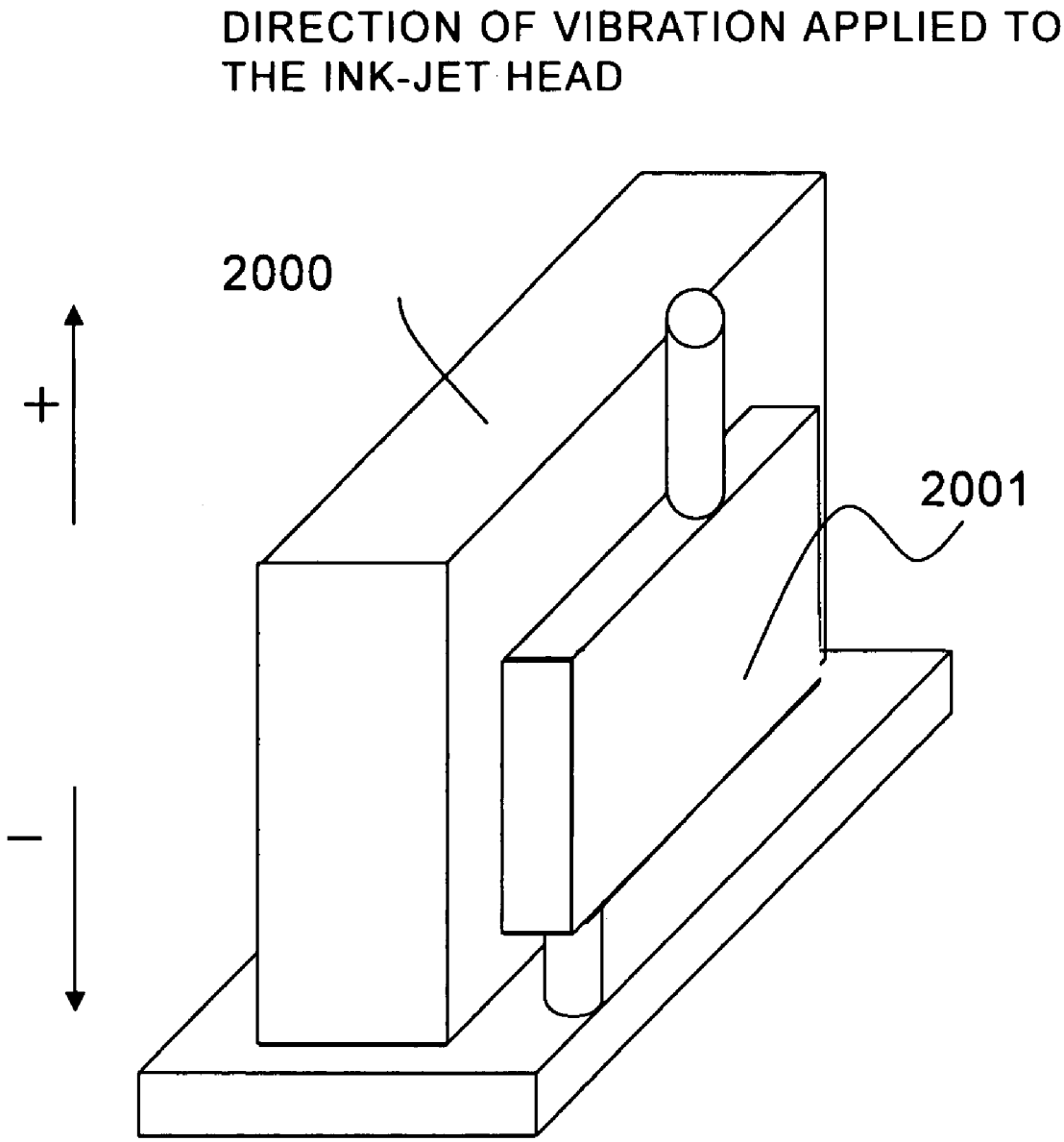
FIG. 11A is a view showing an example of directions in which vibration is applied to an ink-jet head.
Figure 11B:
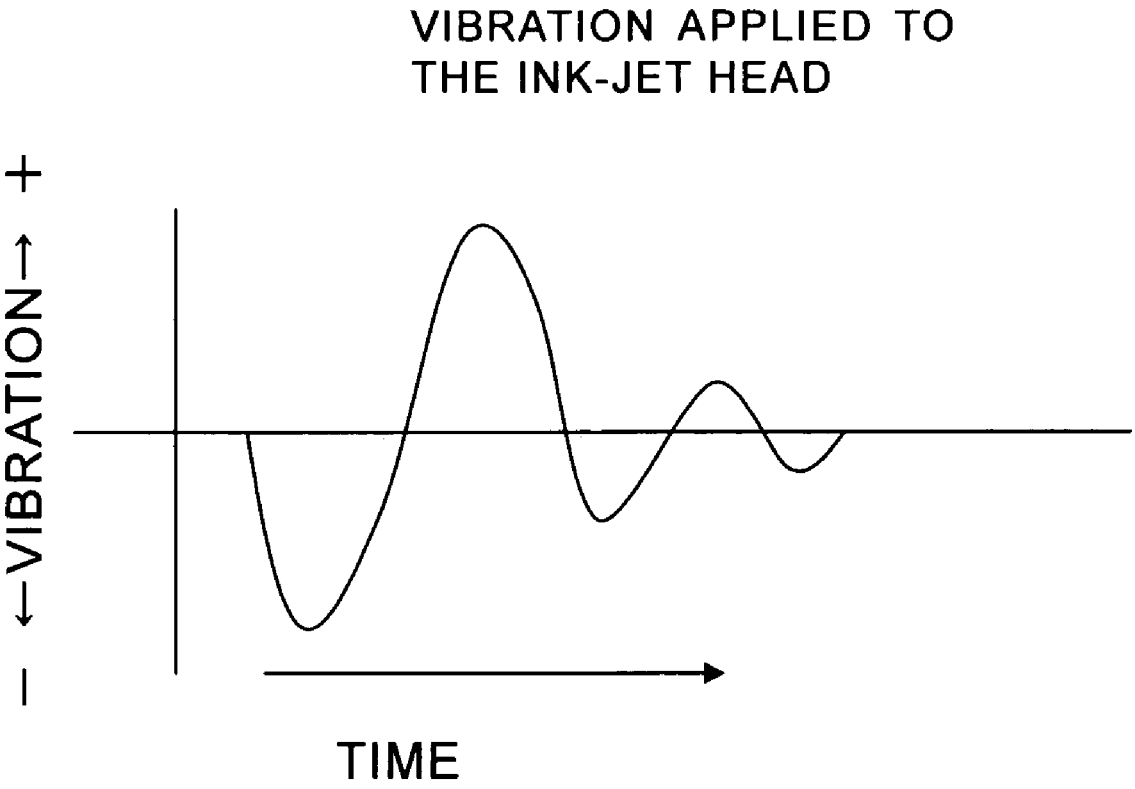
FIGS. 11B to 11D are schematic diagrams each showing the vibration applied to the ink-jet head and a density change in association with vibration.
Figure 11C:
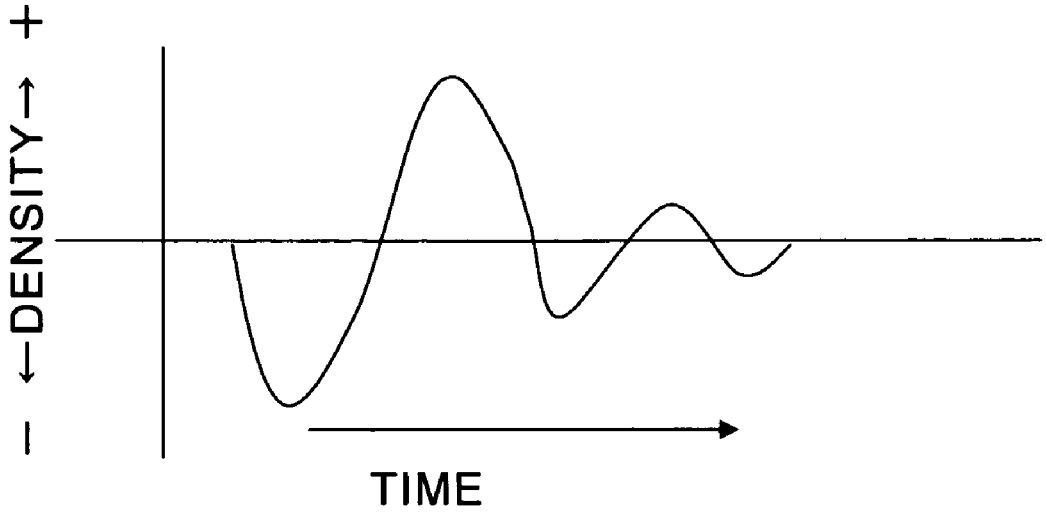
Figure 11D:
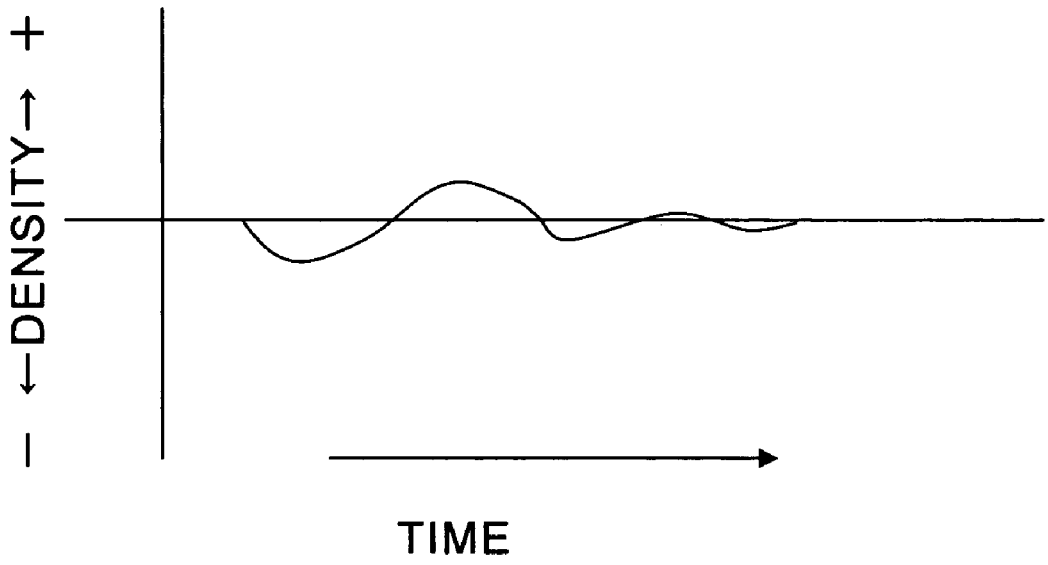

FIG. 10 is a diagram showing a structure of the pressure buffer according to the second embodiment of the present invention. The arrow X of FIG. 10 indicates the gravity direction. In other words, the lower part of FIG. 10 indicates the ground side. In addition, the pressure buffer has a lower portion in the gravity direction, and has an upper portion in a direction opposite to the gravity direction. FIG. 11A is a diagram showing an example of directions in which vibration is applied to the ink-jet head, and specifically shows a vibration direction of each of an ink-jet head 2000 and a pressure buffer 2001. Arrows indicated by "+ " and "– " of FIG. 10 each indicate the direction in which vibration is applied to the ink-jet head 2000 and the pressure buffer 2001. In this case, the arrows "+ " and "– " each indicate the vibration in the vertical direction. FIG. 11B is a diagram showing the vibration applied to the ink-jet head 2000 with respect to a change of elapsed time. FIGS. 11C and 11D are diagrams each showing a change of printing density in a case where the vibration is applied to the ink-jet head 2000.

The second embodiment is different from the first embodiment in that there is provided a penetrating opening portion that defines a through-opening 109 in the vicinity of the ink flow outlet 108 in the partition wall 110, which is pressure suppressing means that suppresses a pressure fluctuation generated in the ink flow path 107 and releasing the pressure fluctuation into the chamber 115.

In a case where the penetrating opening portion 109 is not provided in FIG. 10, when the vibration shown in FIG. 11B is applied in the X direction, the pressure fluctuation is generated due to an inertia of the ink supplied between a space which is confined the pressure indicated by g-g' of FIG. 10. The pressure fluctuation causes a meniscus 104 of the ink-jet head 20 to be displaced, and gives modulation to the volume and the flight of the ink. As a result, the printing density is changed as shown in FIG. 11C. Note that FIG. 11C and 11D each show results obtained by comparing printing materials to be actually printed.

On the other hand, in the case where the penetrating opening portion 109 is provided, the pressure fluctuation generated in the ink flow path 107 is released into the chamber 115 through the penetrating opening portion 109. Accordingly, the displacement of the meniscus 104 can be reduced. As a result, as shown in FIG. 11D, a difference in density is remarkably reduced, which is effective in improving the image quality to a large extent. Further, when the penetrating opening portion 109 is disposed to be as close as possible to ink flow outlet 108, the change in amount of the ink flowing through the ink flow path 107 due to the inertia of the ink is reduced, thereby increasing the above-mentioned effect.

The penetrating opening portion 109 allows the pressure fluctuation generated in the ink flow path 107 to be released into the chamber 115. For this reason, it is desirable to dispose the penetrating opening portion 109 to be as close as possible to the ink flow outlet 108. Further, it is necessary to regulate an opening width of the penetrating opening portion 109 to be set as a predetermined width which does not impair the function of discharging air provided in the pressure buffer and of filling the pressure buffer with ink, when the ink is filled in the pressure buffer. Specifically, the opening width of the penetrating opening portion 109 is set to be narrower than an opening width of the opening portion 101, and a flow path resistance of the penetrating opening portion 109 is set to be larger than that of the opening portion 101. In this manner, the ink and the air supplied in the chamber 115 are discharged through the opening portion 101 with a low flow path resistance, and the chamber 115 can be filled with the ink.

Note that the penetrating opening portion 109 may have any shape and may be set in any direction as long as the pressure fluctuation generated in the ink flow path 107 can be released into the chamber 115.

A specific example of the second embodiment 2 described above will be described below.

Figure 12:
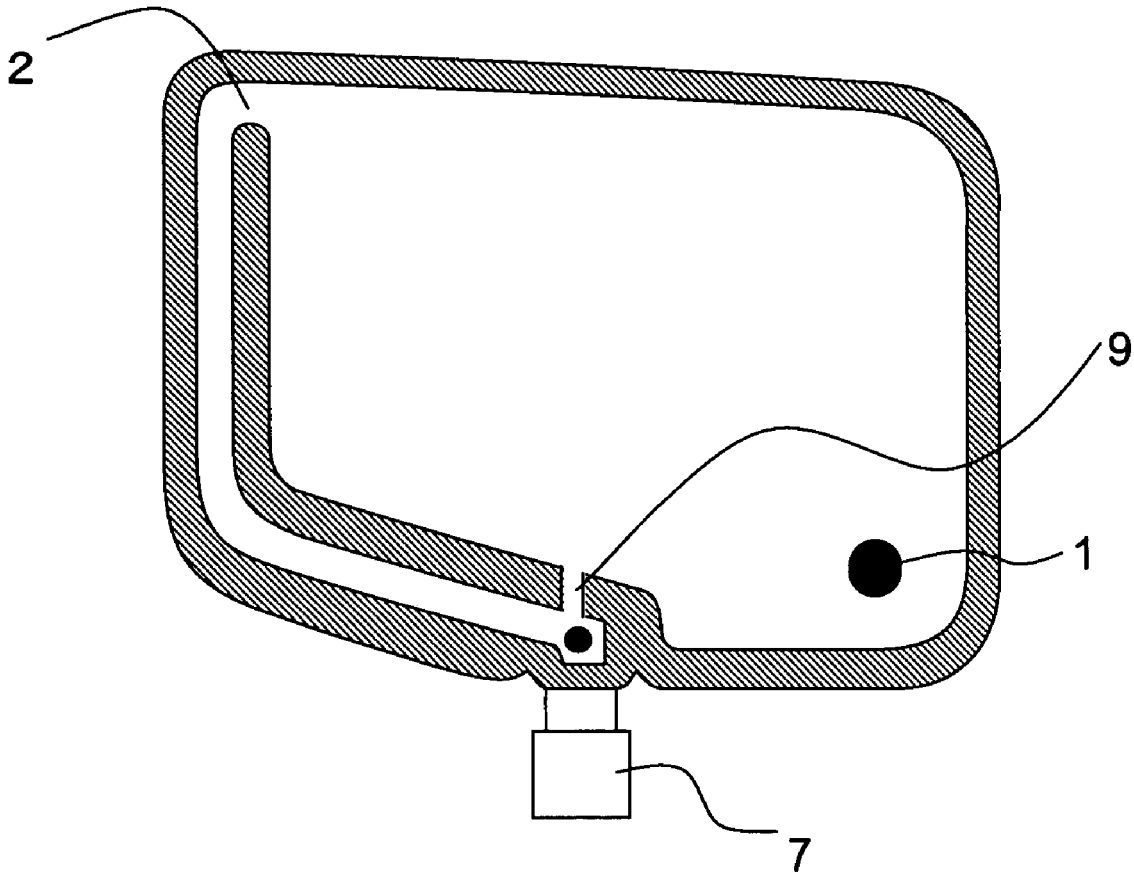
FIG. 12 is a diagram showing a specific example of the pressure buffer according to the second embodiment.

FIG. 12 shows a specific example of a case where the second embodiment is materialized as a plastic molding.

A penetrating opening portion or through-opening 9 of FIG. 12 corresponds to the penetrating opening portion (through-opening) 109 of FIG. 10, and an opening portion 2 of FIG. 12 corresponds to the opening portion 101 of FIG. 10.

The opening width of each of the penetrating opening portion 9 and the opening portion 2 is set such that the flow path resistance of the penetrating opening portion 9 becomes larger than that of the opening portion 2. The ink flow inlet 1 is provided so as to flow the ink into the chamber therethrough, and the ink flow outlet 7 is connected to the ink-jet head so as to discharge the ink.

Figure 13A:
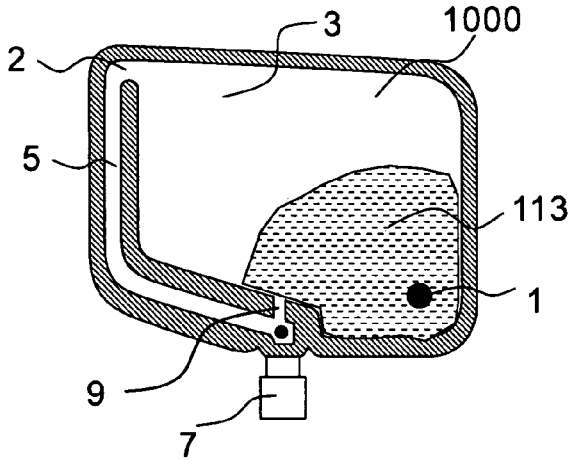
FIGS. 13 are diagrams each showing a state where ink is filled in the pressure buffer which is the specific example according to the second embodiment.
Figure 13B:
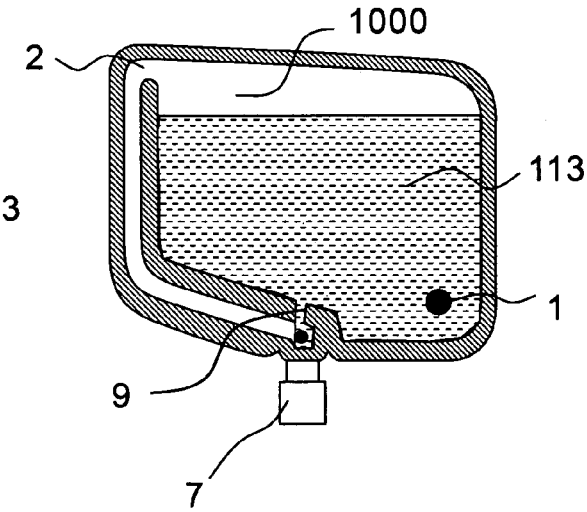
Figure 13C:
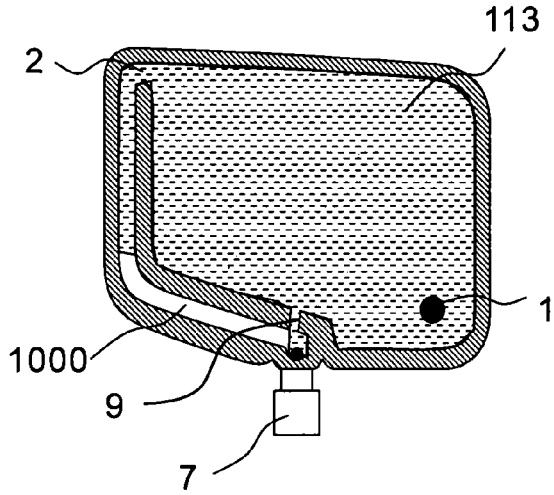
Figure 13D:
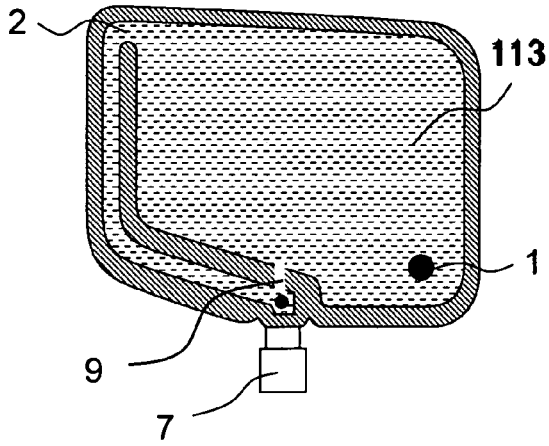

FIGS. 13A to 13D each show a state where the ink is filled in the pressure buffer shown in FIG. 12. In FIG. 13A, in a case where an ink 113 is introduced into the ink flow inlet 1 from a state where the chamber 3 is vacant, the ink 113 is gradually filled from a bottom portion of the chamber 3. Further, as shown in FIGS. 13B, 13C, and 13D in the stated order, the ink 113 and an air 1000 expand to the upper portion of the chamber 3, and are discharged from the opening portion 2 provided in the chamber 3 through the ink flow path 5, the ink flow outlet 7, and the ink-jet head.

(Third Embodiment)

In the second embodiment 2, as a method of alleviating the pressure fluctuation, there is illustrated a method in which the penetrating opening portion is provided in the partition wall, which partitions the link flow path from the chamber, so as to release the pressure fluctuation into the chamber. As long as the pressure fluctuation generated in the ink flowpath can be reduced or alleviated as described above, another method can be employed as the pressure suppressing means. For example, an air pocket for retaining the air may be formed by deforming a part of the partition wall provided in the vicinity of the ink flow outlet, and the pressure fluctuation may be absorbed by utilizing the resilience of the air.

A pressure buffer according to a third embodiment of the present invention which employs the above-mentioned method will be described below.

Figure 14:
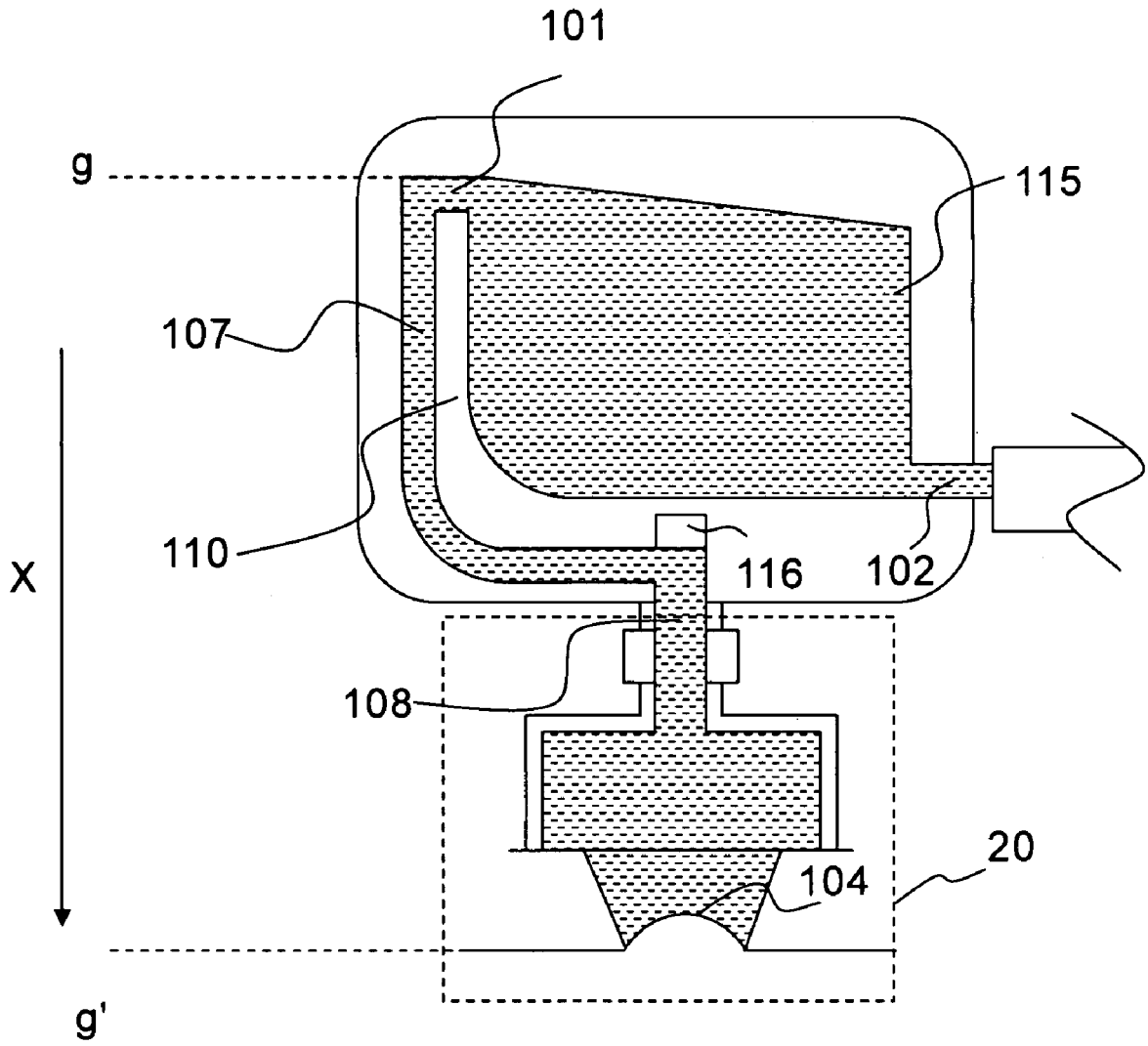
FIG. 14 is a diagram showing a structure of the pressure buffer according to a third embodiment of the present invention.

FIG. 14 is a diagram showing a structure of the pressure buffer according to the third embodiment.

In FIG. 14, an air pocket 116 having a predetermined size is formed in the vicinity of the ink flow outlet 108. The air pocket 116 refers to a space for holding the air provided in the pressure buffer, and also refers to a structure for alleviating the fluctuation in pressure of the ink. In the chamber 115, the ink flow path 107 is formed by providing the partition wall 110, and the chamber 115 communicates with the ink flow path 107 through the opening portion 101 provided in the upper portion of the chamber 115. The ink flows into the chamber 115 from the ink flow inlet 102. The pressure fluctuation generated in the ink flow path 107 is released into the air pocket 116, and is reduced or alleviated due to the resilience of the air. In the case of providing the air pocket, it is desirable to form the air pocket to be as close as possible to the ink flow inlet 108. In the same manner as in the case of providing the penetrating opening portion in the second embodiment, when the air pocket 108 is provided, the displacement of the meniscus 104 of the ink-jet head 20 can be alleviated and the generation of the density unevenness can be reduced to a large extent. Note that the arrow X of FIG. 14 indicates the gravity direction. In other words, the lower side of FIG. 14 indicates the ground side. In addition, the pressure buffer has a lower portion in the gravity direction, and has an upper portion in the direction opposite to the gravity direction.

Note that it is desirable to form the air pocket 116 integrally with the pressure buffer main body which forms the chamber, but the air pocket 116 may be formed by another method.

Figure 15:
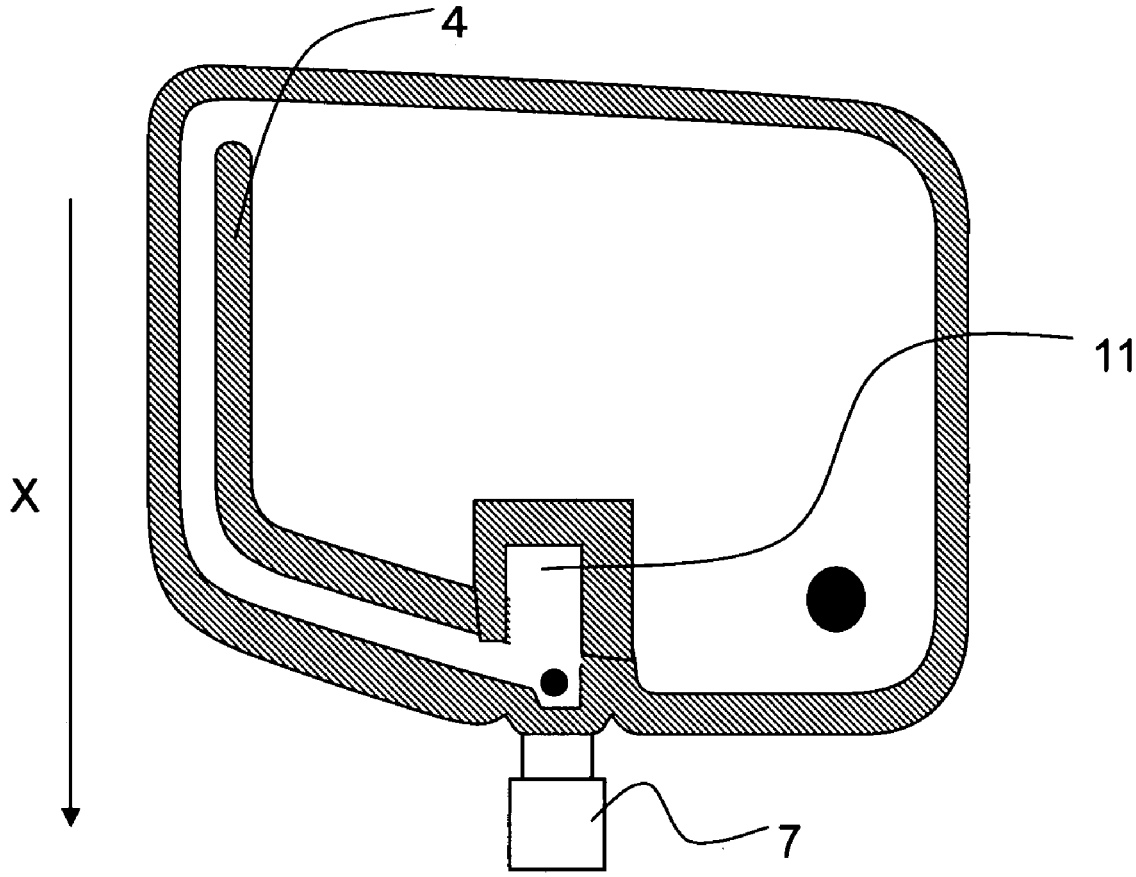
FIG. 15 is a diagram showing a specific example of a pressure buffer according to the third embodiment of the present invention.

A specific example of the third embodiment will be described below. FIG. 15 shows a specific example of a case where the third embodiment is materialized as a plastic molding. The arrow X of FIG. 15 indicates the gravity direction. In other words, the lower side of FIG. 15 indicates the ground side.

In FIG. 15, the partition wall 4 is formed such that a recessed hollow is formed perpendicularly upward in the direction opposite to the gravity direction, to thereby form an air pocket 11. The air pocket 11 corresponds to the air pocket 116 shown in FIG. 14. In the third embodiment, a width and a depth of the air pocket 11 are each in a range from 2 mm to 10 mm, and a height thereof is in a range from 1 mm to 2 mm.

Note that in the third embodiment, the air pocket is formed by deforming the partition wall 4, but the air pocket may be formed by employment of another method so that the air can be held in a predetermined space. For example, an air chamber may be formed integrally with the ink flow outlet.

The embodiments of the present invention have been described above, but the present invention is not limited thereto. Any modification can be made without departing from the scope of the present invention.

What is claimed is:

1. A pressure buffer disposed in an ink supply path that connects an ink supply source to an ink-jet head, the pressure buffer comprising: a chamber having upper and lower portions and having an ink flow inlet through which ink flows from the ink supply source into the chamber and an ink flow outlet through which the ink flows from the chamber to the ink-jet head; a partition wall disposed within the chamber and extending at least partly along a side wall of the chamber to define an ink flow path that communicates through an opening at its upper end with the chamber and that communicates at its lower end with the ink flow outlet so that the ink flows serially from the chamber through the opening into the ink flow path and from the ink flow path through the ink flow outlet into the ink-jet head; and a through-opening in the partition wall in the vicinity of the ink flow outlet and through which the ink flows between the ink flow path and the chamber to suppress pressure fluctuations in the ink flow path.

2. A pressure buffer according to claim 1; wherein the through-opening communicates at its upper end with the chamber at a level vertically lower than that at which the ink flow inlet communicates with the chamber.

3. A pressure buffer according to claim 1; wherein the partition wall has an upper end that is spaced from a wall of the chamber to define the opening which opens into the upper end of the ink flow path, the opening having a flow resistance which is less than that of the through-opening.

4. A pressure buffer according to claim 3; wherein the opening is located at an uppermost portion of the chamber.

5. A pressure buffer according to claim 1; wherein the ink flow inlet is located at a lower portion of the chamber.

6. A pressure buffer according to claim 1; further including a main body having a recessed portion, and a flexible film that overlies and hermetically seals the recessed portion to form the chamber.

7. An ink-jet head that includes the pressure buffer according to claim 1.

8. An ink-jet recording apparatus having the ink-jet head according to claim 7.

9. A pressure buffer disposed in an ink supply path that connects an ink supply source to an ink-jet head, the pressure buffer comprising: a chamber having upper and lower portions and having an ink flow inlet through which ink flows from the ink supply source into the chamber and an ink flow outlet through which the ink flows from the chamber to the ink-jet head; a partition wall disposed within the chamber and extending at least partly along a side wall of the chamber to define an ink flow path that communicates through an opening at its upper end with the chamber and that communicates at its lower end with the ink flow outlet so that the ink flows serially from the chamber through the opening into the ink flow path and from the ink flow path through the ink flow outlet into the ink-jet head; and an air pocket that communicates with the ink flow path in the vicinity of the ink flow outlet to reduce pressure fluctuations in the ink flow path.

10. A pressure buffer according to claim 9; wherein the ink flow inlet is located at a lower portion of the chamber.

11. A pressure buffer according to claim 9; further including a main body having a recessed portion, and a flexible film that overlies and hermetically seals the recessed portion to form the chamber.

12. An ink-jet head that includes the pressure buffer according to claim 9.

13. An ink-jet recording apparatus having the ink-jet head according to claim 12.

14. A pressure buffer disposed in an ink supply path that connects an ink supply source to an ink-jet head, the pressure buffer comprising: a chamber having upper and lower portions and having an ink flow inlet, through which ink flows from the ink supply source into the chamber and an ink flow outlet through which the ink flows from the chamber to the ink-jet head; a partition wall disposed within the chamber and extending at least partly along a side wall of the chamber to define an ink flow path that communicates through an opening at its upper end with the chamber and that communicates at its lower end with the ink flow outlet so that the ink flows serially from the chamber through the opening into the ink flow path and from the ink flow path through the ink flow outlet into the ink-jet head; and pressure suppressing means disposed in the vicinity of the ink flow outlet for suppressing pressure fluctuations in the ink flow path.

15. A pressure buffer according to claim 14; wherein the ink flow inlet is located at a lower portion of the chamber.

16. A pressure buffer according to claim 14; further including a main body having a recessed portion, and a flexible film that overlies and hermetically seals the recessed portion to form the chamber.

17. An ink-jet head that includes the pressure buffer according to claim 14.

18. An ink-jet recording apparatus having the ink-jet head according to claim 17.

* * * * *